US005160082A

United States Patent [19]

McCormick et al.

[11] Patent Number: 5,160,082

[45] Date of Patent: Nov. 3, 1992

[54] LEAK PREVENTING BLANK AND CARTON FOR ICE CREAM AND THE LIKE

[75] Inventors: Robert J. McCormick, Rochester; James C. Zimmerman, North Tonawanda, both of N.Y.; B. Edward Shlesinger, Jr., Alexandria, Va.

[73] Assignee: Somerville Packaging, Rochester, N.Y.

[21] Appl. No.: 836,851

[22] Filed: Feb. 19, 1992

[51] Int. Cl.[5] ..... B65D 5/02

[52] U.S. Cl. ..... 229/134; 229/227

[58] Field of Search ..... 229/134, 227, 226, 225, 229/224, DIG. 4, 132

[56] References Cited

U.S. PATENT DOCUMENTS

| | | | |
|---|---|---|---|
| 1,847,834 | 3/1932 | Iacobitti | 229/134 |
| 3,315,870 | 4/1967 | Barnes | 229/227 |
| 3,361,328 | 1/1968 | Buttery | 229/134 |
| 3,524,581 | 8/1970 | Buttery | 229/51 |
| 3,731,871 | 5/1973 | Buttery et al. | 229/227 |
| 3,734,390 | 5/1973 | Buttery et al. | 229/227 |
| 3,735,916 | 5/1973 | Buttery | 229/227 |
| 3,833,165 | 9/1974 | Hoiles | 229/227 |
| 3,899,120 | 8/1975 | Fradkin | 229/DIG. 4 |
| 4,501,388 | 2/1985 | Cassidy | 229/134 |
| 4,555,027 | 11/1985 | Froom | 206/626 |
| 4,712,689 | 12/1987 | Froom | 206/626 |
| 4,712,730 | 12/1987 | Froom | 229/169 |
| 4,749,086 | 6/1988 | Donohie | 229/227 |
| 4,756,470 | 7/1988 | DePaul | 229/134 |
| 4,757,902 | 7/1988 | Hutchinson et al. | 229/227 |
| 4,819,864 | 4/1989 | Capuano | 229/135 |
| 4,872,609 | 10/1989 | DePaul | 229/134 |
| 4,907,698 | 3/1990 | Konrad et al. | 229/134 |
| 4,989,780 | 2/1991 | Foote et al. | 229/132 |
| 5,033,622 | 7/1991 | DePasquale et al. | 229/227 |

*Primary Examiner*—Allan N. Shoap
*Assistant Examiner*—Christopher J. McDonald
*Attorney, Agent, or Firm*—Shlesinger, Arkwright & Garvey

[57] ABSTRACT

A leak preventing carton and blank for ice cream and the like in which the first-in and flap substantially closes the opening of the carton but leaves a gap along the top edge of the first-in flap which gap is prevented from becoming a leaking area by a boss such as a deboss which may or may not be used in conjunction with an emboss. The boss or bosses cooperate to seal the area of the gap from leakage. In addition, the carton is designed to provide for very tight corners in which excess material is provided in the blank for closing tightly the corners when the carton is erected for receiving ice cream.

39 Claims, 4 Drawing Sheets

FIG. 1 - (Interior)

FIG. 2-(Interior)

LEAK PREVENTING BLANK AND CARTON FOR ICE CREAM AND THE LIKE

FIELD OF THE INVENTION

This invention pertains to a blank and a carton for packaging ice cream and the like. The carton and blank have many characteristics and features of end filled ice cream cartons now presently on the market such as lip seal, for top and bottom end flaps, the tamper-evident feature including a tear-away strip on the front panel of the carton, and a deep hood which pivots upwardly upon removal of the tear-strip and which can be readily replaced on top of the carton after a serving of ice cream has been extracted from the opened carton. The carton generally also includes a break-away feature designed to maintain seal on the carton prior to removal of the tear-strip and the lifting of the hood. Another general feature of this invention is the incorporation of a single glue line at either end of the carton sleeve when the flaps are in-folded in the filling operation.

BACKGROUND OF THE INVENTION

In the past, ice cream cartons which are end-filling and top-opening, have had problems with leakage at the corners. During the filling operation, the ice cream is in a semi-viscous form and has not been solidly frozen as you would find in the stores. After leaving the filling machine, the ice cream carton is placed in a chiller which freezes the contents solid. During the solid freezing operation, the ice cream tends to leak from the carton ends at the corners and various areas where the flaps overlap. Thus, testing for leakage in a carton would be done by taking filled cartons and leaving them on a shelf at room temperature until ice cream begins to ooze from the bottom of the carton. Because of the susceptibility of leakage, it is important that the cartons reach the chiller as soon as possible in order to prevent leakage from starting at the ends. Different dairies have different packaging conditions and temperatures vary widely in different parts of the country. Thus the longer that leakage can be prevented, the less likelihood of rejection of certain cartons because of excess build-up of ice cream on the outside thereof. The purchaser does not want to see the ice cream on the outside of the carton and rejects those that are found packaged in this fashion.

It should also be noted, that different types of ice cream have different consistencies. Sherbet, for example, tends to melt much faster than heavier types of ice cream. Thus chilling of sherbet in the package becomes more critical than a heavy ice cream. The longer a leak can be prevented, the fewer rejects there are. Packing a large number of cartons adjacent each other in the chiller also creates a problem in that those cartons that are centrally located in a chiller, do not freeze as quickly as outer perimeter cartons. Contrary to popular belief, the ice cream carton itself is not sealed all around by some type of bonding agent such as glue or the like. The flaps, upon in-folding, are secured in an overlying manner by means of glue which is applied only to certain flaps and in a line. The glue is provided to prevent the flaps from flying open after closing. The glue does not overlie a seam in the carton as might be expected.

It should be stated, that the carton blank is formed into a sleeve which does have a glue line running the length of one panel thereof which bonds that panel to the flap having the tear-strip thereon. Thus leakage is not around the central portion of the carton but at the ends. Bosses have been used in the past to provide for proper closing of cartons so that when glue is applied, an adjacent flap surface will not be lower than the glue application surface of the initial flap portion; i.e. the adjacent flap area to which glue will be applied to and extended over onto the next flap. This can be readily seen in the use of bosses such as embosses in Buttery U.S. Pat. Nos. 3,524,581 and 3,735,916, De Paul 4,756,470.

Many patents have been granted to provide features which will delay leakage such as Froom U.S. Pat. Nos. 4,555,027, 4,712,689, 4,712,730, DePaul U.S. Pat. Nos. 4,756,470, 4,872,609, Capuano 4,819,864 and Hutchinson, et al. 4,757,902.

OBJECTS AND SUMMARY OF THE INVENTION

It is an object of the present invention to provide an improved carton and blank for ice cream which will delay leakage of a semi-viscus ice cream for a substantial period to enable chilling to harden the ice cream in the container prior to leakage setting in.

Yet another object of this invention is to provide a carton and blank which will conform to standard filling machines.

Yet a further object of this invention is to provide a carton blank which in the manufacture thereof can be nested in such a manner as to produce the maximum number of blanks from a piece of board with a minimum amount of waste.

Yet another object of this invention is to provide a carton and blank which will be attractive and commercially appealing to the dairies who fill the cartons.

Still a further object of this invention is to provide a carton blank which can be readily color printed and which when assembled in carton form will produce an attractive carton with a minimum number of irregular lines in the carton itself.

Another object of this invention is to provide a carton which has tight fitting corners upon erection of the carton from the blank thereby reducing leakage.

Yet another object of this invention is to provide a carton which incorporates means for reducing leakage along lines of gap.

In summary, the present invention discloses a novel configuration for carton blanks and for cartons which includes means for improving the seal and the overall appearance of the carton. These and other objects of the invention will be apparent from the following:

DETAILED DESCRIPTION OF THE INVENTION

Figure 1:
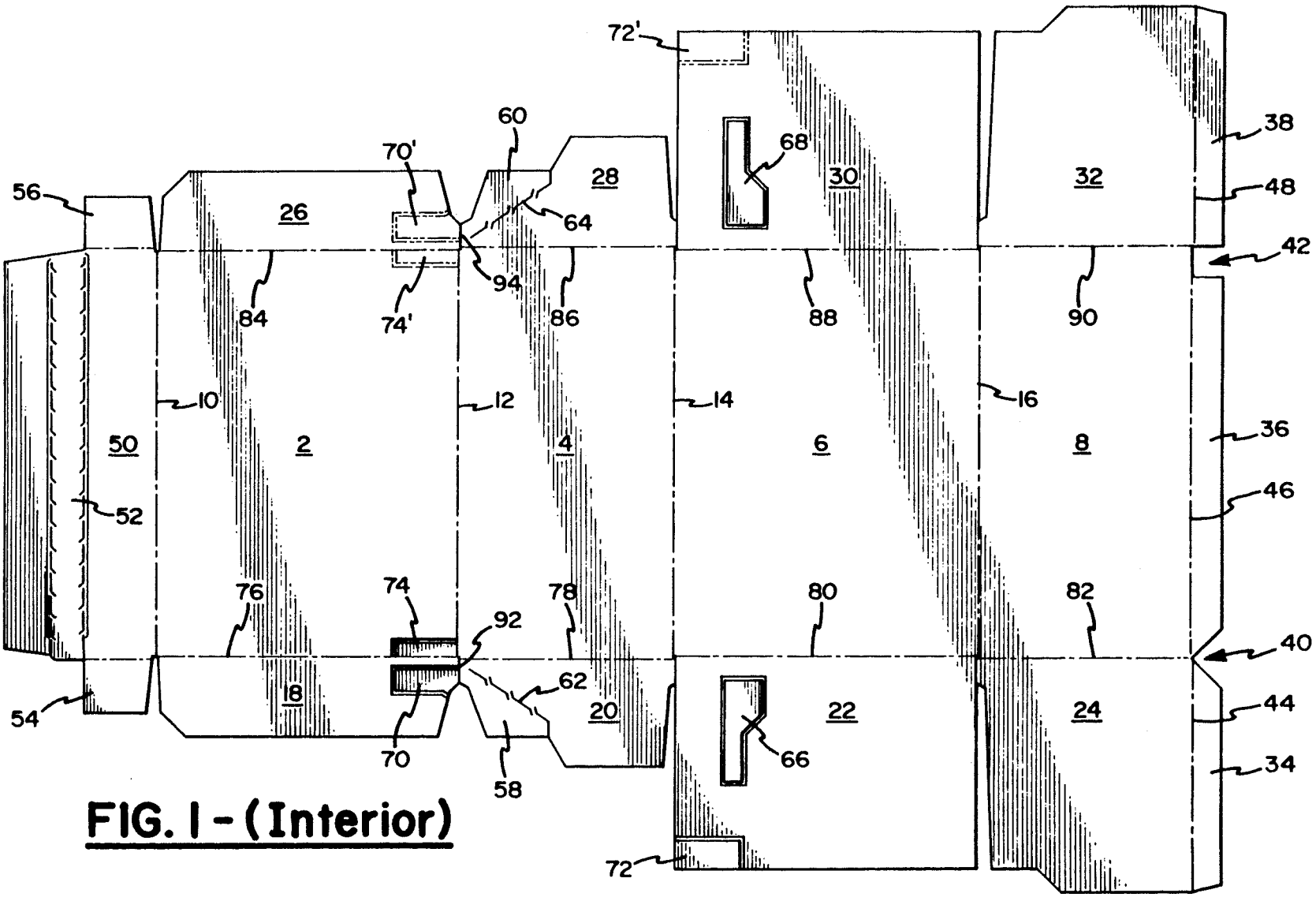
FIG. 1 is a top plan view of the interior of the carton blank. Various bosses are shown at the top or the bottom of the blank.

In FIG. 1, the blank B is made from standard carton board or other materials as desired by the trade. The blank B includes rectangular panels 2, 4, 6 and 8. The panels are folded on fold lines 10, 12, 14 and 16 to make a rectangular sleeve. Panels 2, 4, 6 and 8 have respectively lower flaps 18, 20, 22 and 24 and upper flaps 26, 28, 30 and 32. Flaps 24 and 32 as well as panel 8 to which these flaps are attached, have lips 34, 36 and 38 respectively. The lips 34, 36 and 38 are well known in the art and include cutouts 40 and 42. Hinges 44, 46 and 48 are provided on flaps 24, panel 8, and flap 32 respectively for infolding purposes known in the art.

Tear strip flap 50 is secured to panel 2 at the hinge or fold line 10 and includes tear strip 52 and fold back tabs 54 and 56 which are folded back over flaps 18 and 26 respectively and glued thereto in the assembled carton.

Flaps 20 and 28 include breakaway tabs 58 and 60 with tear lines 62 and 64. Glue line embosses 66 and 68 are provided on respective flaps 22 and 30.

Referring to the bottom of the blank B, it will be noted that flap 18 incorporates a deboss 70 and flap 22 incorporates an emboss 72. If the deboss 70 extends below the inside surface of the blank B a thickness equalled to the carton board, then the emboss 72 will not be necessary. However, in order to prevent tearing or cutting of the board material during boss operations, the deboss 70 may be of a slight depth less than the thickness of the board which then permits the emboss 72 to cooperate therewith to provide the additional thickness required. Thus, bosses 70 and 72 overly each other when the blank is folded into a carton. As shown in phantom lines in the upper portion of the blank B, deboss 70' and emboss 72' work in the same manner as bosses 70 and 72. It will be noted that panel 2 has deboss 74 thereon in the lower right hand corner and a deboss 74' shown in the upper right hand corner of panel 2. Either debosses 70 and 70' or 74 and 74' may be used alone or in conjunction with each other and with embosses 72 and 72'. In the preferred embodiment, debosses 70 and 70' and cooperating embosses 72 and 72' are used without the debosses 74 and 74'.

Flap fold lines 76, 78, 80, 82, 84, 86, 88 and 90 are provided for their respective flaps 18, 20, 22, 24, 26, 28, 30 and 32. It should be noted in FIG. 1, that the cut throughs 92 and 94 between the flaps 18 and 20 and 26 and 28 respectively are offset to the right of the fold line 12. This allows for additional material on the flaps 18 and 26 so that when infolded, they will form with the infolded flaps 20 and 28 respectively, a tight corner reducing leakage at the corner. Such tight corners are also provided between adjacent flaps which are provided with overlap on one of the flaps beyond the fold line of the panels as will be noted between adjacent flaps 20 and 22, 22 and 24, 28 and 30, and 30 and 32.

FIGS. 3–8

Figure 3:
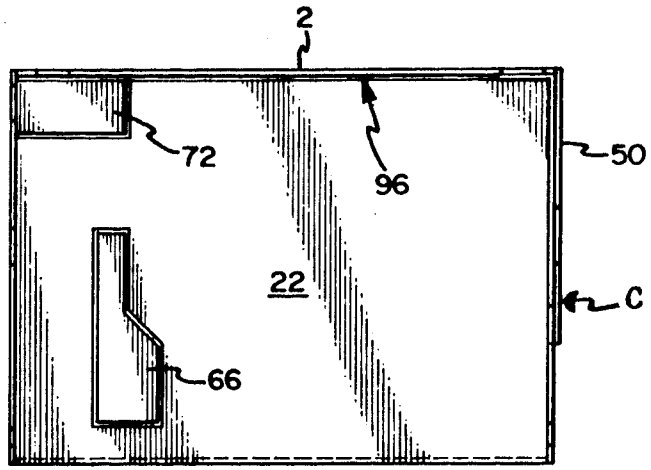
FIG. 3 is a side elevational view of the carton when erected with the first end flat shown in position.

FIG. 3 shows the first end flap 22 with the embosses 66 and 72. A gap 96 is created between the top edge of the flap 22 and the inside surface of the cover panel 2. This gap is about the thickness of the board from which the blank B is constructed. It should be noted that the emboss 72 borders on the edge of the flap 22 and that the gap 96 continues across the top edge emboss 72.

Figure 4:
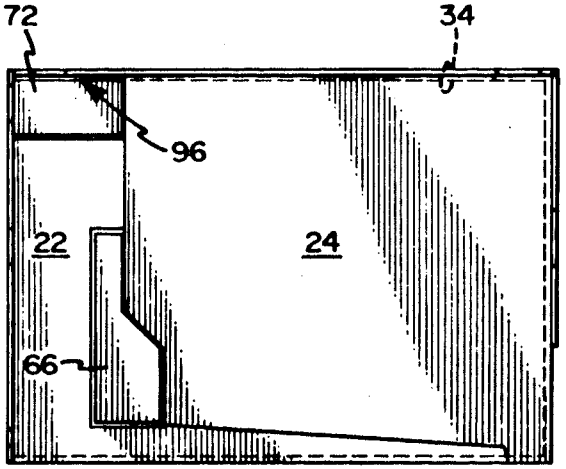
FIG. 4 is a side elevational view of the erected carton with the first and second end flaps shown in position.

Referring now to FIG. 4, it will be noted that the flap 24 overlies the flap 22 and becomes the second-in flap. The lip 34 as best shown in FIG. 1 is folded in and into the gap 96 to seal the first portion of the gap 96 on the right hand side but it does not seal the second portion of the gap 96 on the left hand side which is the area adjacent the emboss 72. It should also be noted that the left hand edge of the flap 24 cooperates with the edge of the emboss 66 and the emboss 72 and abuts both these embosses 66 and 72.

Figure 5:
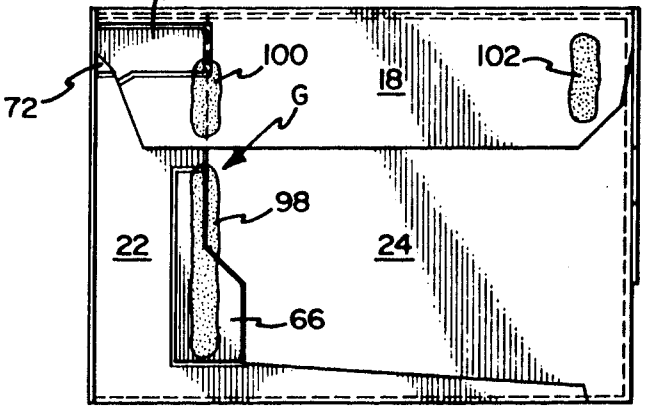
FIG. 5 is a side elevational view of the erected carton with the first, second and third end flaps shown in position.

In FIG. 5, the third-in end flap 18 now overlies the flaps 22 and 24 and deboss 70 overlies and is in contact with emboss 72. A glue line G is shown with glue in the areas 98 and 100 on emboss 66, flap 24 and flap 18.

Figure 6:
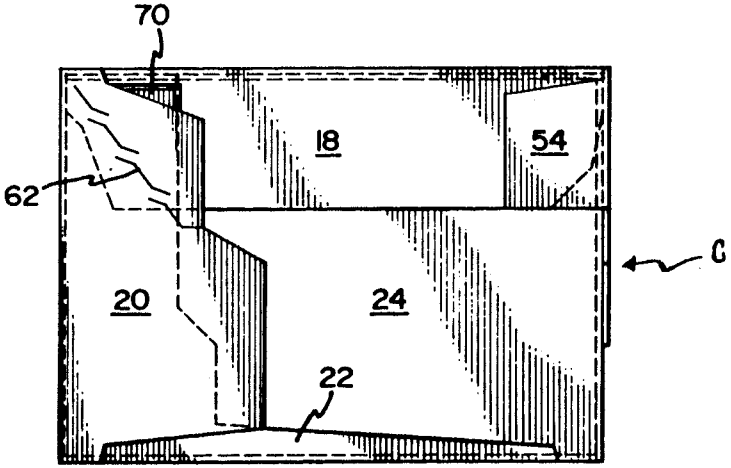
FIG. 6 is a side elevational view of the erected carton with the first, second, third and fourth end flaps in position and the hood tab positioned over the third-end flap.
Figure 7:
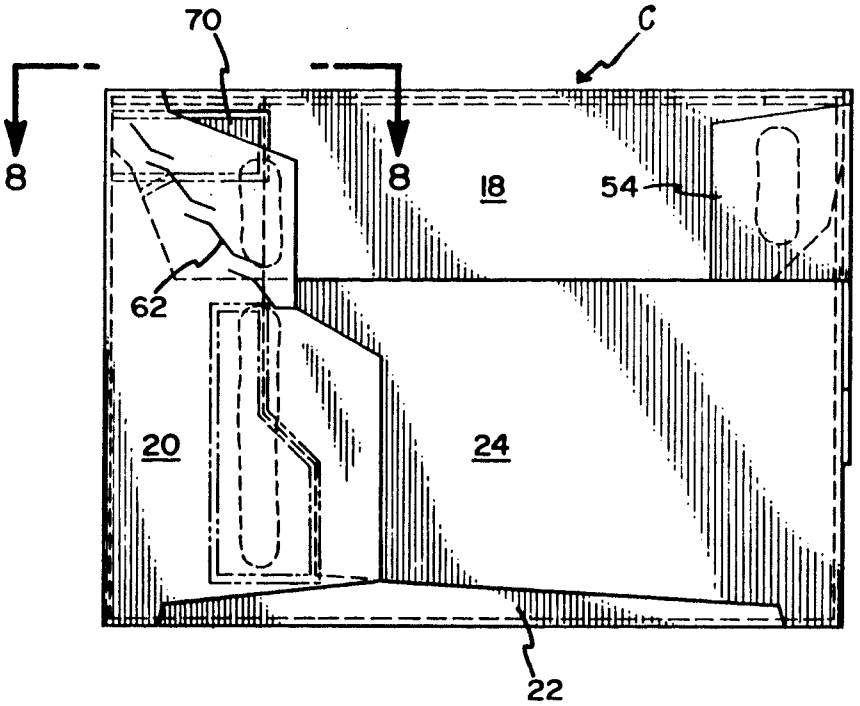
FIG. 7 is a side elevational view of the carton from one end showing in phantom lines where the glue is applied and where the bosses are positioned.

Referring now to FIG. 6, flap 20 is now positioned to overlie flaps 22, 24 and 18 and is bonded to these flaps by the glue line G and glue portions 98 and 100. Tab 54 is bonded to the flap 18 by glue 102 as shown in FIG. 5. The overlying effect is also shown by FIG. 7. The opposite end of the carton C would be formed in the same manner with a similar glue line G incorporated for securing the end flaps 26, 28, 30 and 32 (not shown in folded position).

Figure 8:
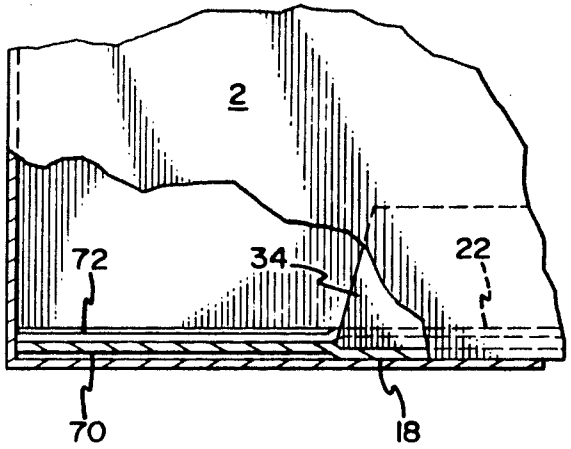
FIG. 8 is a fragmentary cross sectional view taken along the lines 88 in FIG. 7 and viewed in the direction of the arrows.

FIG. 8 is enlarged to show the cooperating deboss 70 and emboss 72 on the respective panels 18 and 22.

FIG. 9

Figure 2:
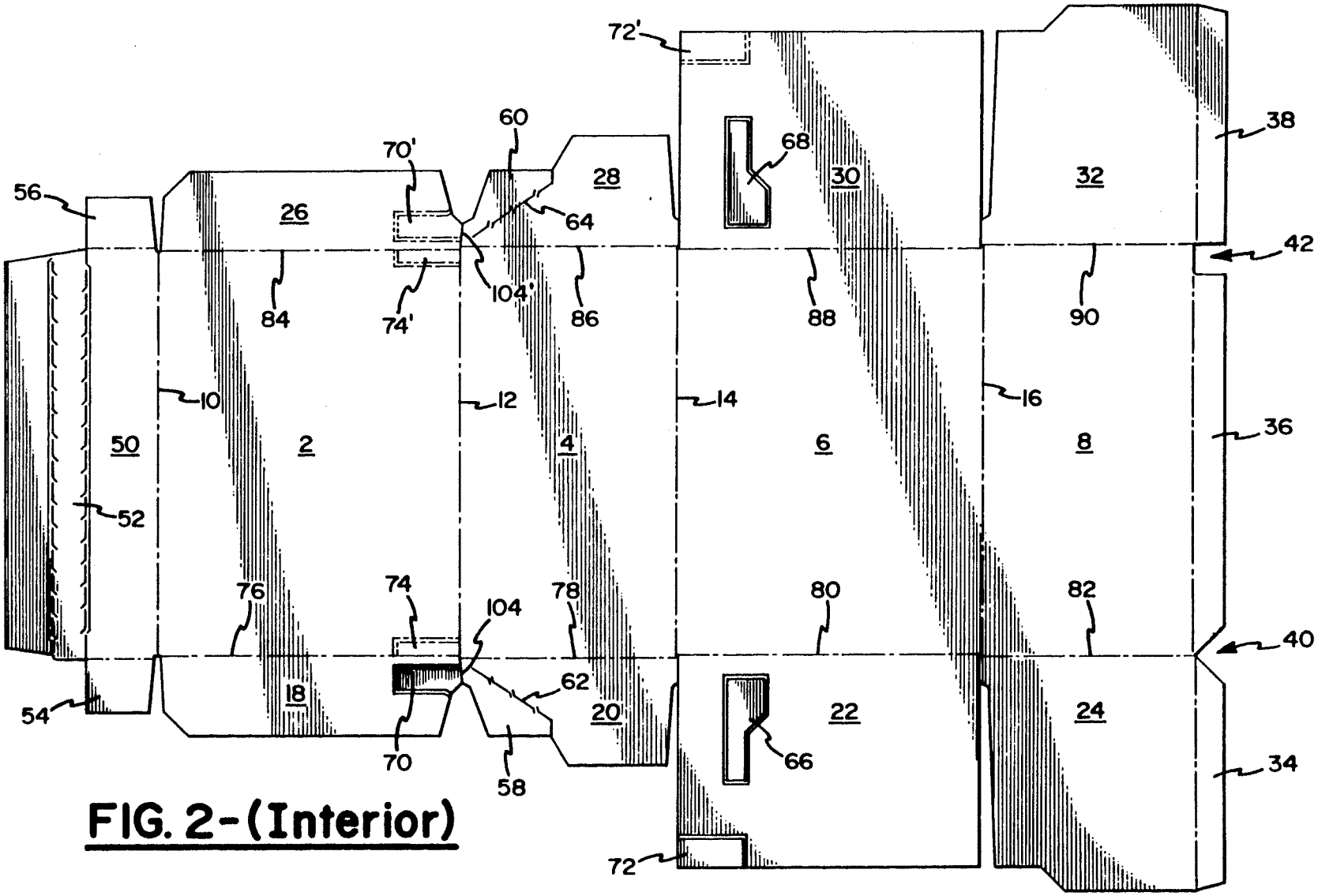
FIG. 2 is an interior top plan view of a modified blank showing various bosses incorporated therein.
Figure 9:
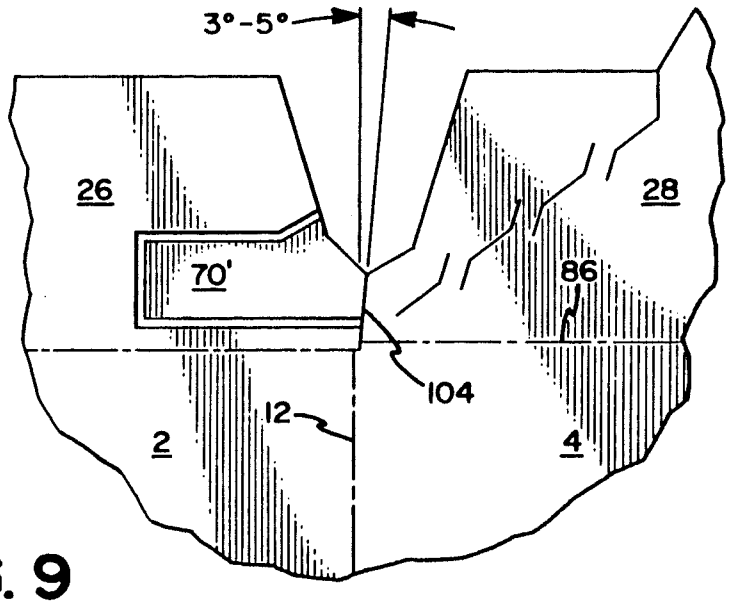
FIG. 9 is an enlarged fragmentary view of modification of the carton as shown in the upper portion circular dash lines of FIG. 2.

Referring now to FIG. 9 is enlarged and is taken from FIG. 2. It will be noted that the cut-through 104 is angled between about 3 degrees and 5 degrees and that flap 26 extends beyond the fold line 12. The purpose of this cut through 104 at an angle about 3 degrees to about 5 degrees is to provide additional material in the corner when flap 28 is folded over flap 26. This crowds the corner and provides an excellent seal for the corner to avoid leakage. Obviously the same arrangement is made on the lower portion of the blank as in the upper portion as shown. Note in FIG. 2 the angle cut 104 is shown at the bottom.

OPERATION

It will now be observed that by gluing (not shown) the flap 50 onto the panel 8, a tube or sleeve is formed which can then be erected for filling purposes. It will also be observed that the various bosses such as the debosses 70 and 70' and 74 and 74' can be used by themselves or in conjunction with the embosses 72 and 72' to effectively provide a mechanism for preventing leakage out the second portion of the gap 96 which is not covered by the infolding lips 34 and 38. Ice cream attempting to get through the second portion of the gap 96 which is adjacent the debosses 70 and 70' or the debosses 74 or 74' will be prevented from coming down between flap 22 and the overlying flap 20 or flap 30 and its overlying flap 28. Furthermore, it will be noted that the tight corners formed by the angled cut throughs 104 and 104' as well as the offset arrangement such as illustrated by the cut throughs 92 and 94 will additionally prevent leakage.

While this invention has been described as having a preferred design it is understood that it is capable of further modifications, uses and/or adaptations of the invention following in general the principle of the invention and including such departures from the present disclosure as come within known or customary practice in the art to which the invention pertains, and as may be applied to the central features hereinbefore set forth, and fall within the scope of the invention of the limits of the appended claims.

Having thus described our Invention, what we claim is:

1. A leak preventing carton for ice cream and the like comprising:

a) a rectangular sleeve of uniform thickness having top and bottom and inner walls forming a chamber for receiving ice cream;

b) said bottom and top each having inwardly folded first-in and second-in end flaps;

c) each of said end flaps having first, second and top edges;

d) at least one of said first-in end flaps substantially closing the corresponding one of said top and bottom of said sleeve except for a uniformly wide gap formed between said top edge of said at least one of said first-in end flaps and the corresponding inner wall;

e) said gap extending the length of the top edge of the corresponding one of said first-in end flaps;

f) said gap having first and second portions;

g) at least one of said second-in end flaps including an infolded lip extending into said gap and filling substantially only said first portion; and said sleeve having a deboss adjacent said second gap portion and extending the length of said second gap portion for preventing leakage through said second gap portion.

2. A leak preventing carton as in claim 1 and wherein:

a) said bottom and top each has inwardly folded third-in end flaps, and the corresponding one of said third-in end flaps includes said deboss.

3. A leak preventing carton as in claim 2 and wherein:

a) said deboss on the corresponding one of said third-in end flaps overlies and is in contact with the corresponding first-in end flap and is adjacent to said second gap portion.

4. A leak preventing carton as in claim 2 and wherein:

a) said deboss on the corresponding one of said third-in end flaps is of a depth substantially the thickness of said sleeve.

5. A leak preventing carton as in claim 2 and wherein:

a) said deboss on the corresponding one of said third-in end flaps is substantially rectangular.

6. A leak preventing carton as in claim 1 and wherein:

a) said sleeve includes a top panel extending from the top of the bottom of said sleeve and having a top and bottom and sides and said deboss is formed in one of said top and bottom of said top panel adjacent said second gap portion.

7. A leak preventing carton as in claim 2 and wherein:

a) at least one of said first-in end flaps has an emboss in contact with and cooperating with said deboss.

8. A leak preventing carton as in claim 1 and wherein:

a) said first-in end flaps are substantially rectangular in shape.

9. A leak preventing carton as in claim 7 and wherein:

a) said first-in end flap's emboss is located at its top edge adjacent said second gap portion.

10. A leak preventing carton as in claim 1 and wherein:

a) said rectangular sleeve include a series of panels each having top and bottom and fold lines between said panels and said panels being joined at their top and bottom by said end flaps extending from either side of said panels; and b) said bottom and top of said sleeve each has inwardly folded third-in and fourth-in end flaps, and each of said third-in end flaps at their juncture with said fourth-in end flaps is provided with about a 3° to 5° bevel extending toward said four-in end flaps for providing a press fit at said juncture when said flaps are infolded.

11. A leak preventing carton as in claim 10 and wherein:

a) each said third-in each flap at the corresponding juncture with each fourth-in end flap extends beyond the fold line of their respective panels.

12. A leak preventing carton as in claim 7 and wherein:

a) said cooperating emboss and deboss together are substantially the thickness of said sleeve.

13. A leak preventing carton as in claim 1 and wherein:

a) said bottom and top each has inwardly folded third-in and fourth-in end flaps, and the corresponding top and bottom first-in and third-in end flaps each have bonding means therein; and b) said fourth-in end flaps being bonded to the corresponding first-in and third-in end flaps thereby sealing said carton.

14. A leak preventing carton as in claim 13 and wherein:

a) said bonding means comprises a glue line.

15. A leak preventing carton as in claim 14 and wherein:

a) said glue line is broken.

16. A leak preventing carton blank for ice cream or the like comprising:

a) a plurality of panels for forming a rectangular sleeve of uniform thickness having a top and bottom and inner walls for forming a chamber for receiving ice cream when the carton blank is erected;

b) said bottom ad top each having inwardly foldable first-in and second-in end flaps;

c) each of said end flaps having first, second and top edges;

d) said first-in end flaps each when folded in substantially closing the corresponding one of said top and bottom of said sleeve except for a uniformly wide gap formed between said top edge of said first-in end flaps and the corresponding inner wall;

e) said gaps each extending the length of the top edge of said first-in end flaps;

f) said gaps each having first and second portions;

g) said second-in end flaps each including a foldable lip extendable into the corresponding gap when said second-in end flaps are each folded in for filling substantially only said first portion; and h) said blank having a pair of bosses such that when erected one of said pair of bosses being positioned directly adjacent each of said second portions of said gaps for preventing leakage therethrough, said bosses extending substantially the length of said second gap portions.

17. A leak preventing carton blank for ice cream or the like as in claim 16 and wherein:
a) said bottom and top each has inwardly folded third-in end flaps, and said third-in end flaps each include one of said pair of bosses.

18. A leak preventing carton blank for ice cream or the like as in claim 17 and wherein:
a) when said flaps are infolded said boss on each of said third-in end flaps overlies and is in contact with the corresponding first-in end flap and in adjacent to the corresponding second gap portion.

19. A leak preventing carton blank for ice cream or the like as in claim 17 and wherein:
a) said boss on each of said third-in end flaps is of a depth substantially the thickness of said sleeve.

20. A leak preventing carton blank for ice cream or the like as in claim 17 and wherein:
a) said boss on each of said third-in end flaps is substantially rectangular.

21. A leak preventing carton blank for ice cream or the like as in claim 16 and wherein:
a) said sleeve includes a top panel extending from the top to the bottom of said sleeve and having top, bottom and sides and one of said pair of bosses is a deboss formed in one of said top and bottom of said top panel and adjacent the corresponding gap when said end flaps are infolded.

22. A leak preventing carton blank for ice cream or the like as in claim 17 and wherein:
a) each of said pair of bosses is a deboss; and
b) said first-in end flaps each have an emboss in contact with and cooperating with the corresponding deboss when said first-in and third-in end flaps are infolded.

23. A leak preventing carton blank for ice cream or the like as in claim 22 and wherein:
a) said first-in end flaps are each substantially rectangular in shape.

24. A leak preventing carton blank for ice cream or the like as in claim 22 and wherein:
a) each of said first-in end flap's emboss is located at its top side edge and adjacent the corresponding second gap portion when said flaps are infolded.

25. A leak preventing carton blank for ice cream or the like as in claim 16 and wherein:
a) said rectangular sleeve includes a series of panels each having atop and bottom, and having fold lines between said panels, and said panels are joined at their top and bottom by said end flaps extending from either side of said panels;
b) said bottom and top of said sleeve each has inwardly foldable third-in and fourth-in end flaps; and
c) each of said third-in end flaps at their juncture with said fourth-in end flaps is provided with about a 3° to 5° bevel extending toward said fourth-in end flaps for providing a press fit at said juncture when said flaps are infolded.

26. A leak preventing carton blank for ice cream or the like as in claim 25 and wherein:
a) each of said third-in end flaps at their juncture with said fourth-in end flaps extends beyond the fold line of their respective panels.

27. A leak preventing carton blank as in claim 22 and wherein:
a) each of said cooperating embosses and debosses together are substantially the thickness of said sleeve.

28. A leak preventing carton blank for ice cream and the comprising:
a) said blank having a top and a bottom and having a series of panels each having a top and bottom extending from said top to said bottom of said blank and separated by fold lines;
b) said panels foldable along said fold lines to form a rectangular sleeve forming a chamber for receiving ice cream;
c) said panels each joined at their top and bottom by an end flap;
d) each of said end flaps being separated from each other and individually foldable inwardly to close said sleeve and form a closed carton; and
e) said top and bottom of said panels having at least one of two adjacent end flaps at their juncture provided with about a 3° to 5° bevel towards the other of said adjacent end flaps for providing a press fit at said juncture when said sleeve is formed and said flaps are infolded for sealing said carton.

29. A leak preventing carton blank as in claim 28 and wherein:
a) said at least one of said two adjacent end flaps extends beyond the fold line of their respective panels.

30. A leak preventing carton for ice cream and the like comprising:
a) a rectangular sleeve having a top and bottom;
b) said sleeve formed by a series of panels separated by fold lines;
c) said panels each joined at their top and bottom by an end flap;
d) each of said end flaps being separated from each other and individually folded inwardly to close said sleeve and form a closed carton; and
e) said top and bottom of said panels having at least one of two adjacent end flaps at their juncture provided with about a 3° and 5° bevel toward the other of said adjacent end flaps providing a press fit at said juncture for sealing said carton.

31. A leak preventing carton as in claim 30 and wherein:
a) said at least one of said two adjacent end flaps extends beyond the fold line of their respective panels.

32. A leak preventing carton for ice cream and the like comprising:
a) a sleeve of uniform thickness having a top and bottom and inner walls forming a chamber for receiving ice cream;
b) said bottom and top each having at least inwardly folded first-in and second-in end flaps;
c) each of said end flaps having first, second and top edges;
d) said first-in end flaps each substantially closing the corresponding one of said top and bottom of said sleeve except for a uniformly wide gap formed between said top edge of said first-in end flaps and the corresponding inner wall;
e) said gaps each extending above the top edge of the corresponding first-in end flap;
f) said second-in flaps each overlying and in contact with a substantial portion of the corresponding first-in end flap and overlying said gap; and
g) said sleeve having adjacent its top and bottom boss means adjacent said gap for cooperating with an additional carton element for preventing leak age through said gap.

33. A leak preventing carton as in claim 32 and wherein:

a) each of said boss means includes a substantially rectangular base.

34. A leak preventing carton blank for ice cream or the like comprising:

a) means for folding said blank into a sleeve of uniform thickness having a top and bottom and inner walls for forming a chamber for receiving ice cream when the carton blank is erected.

b) said top and bottom each having inwardly foldable first-in and second-in end flaps;

c) each of said end flaps having first, second and top edges;

d) said first-in end flaps each when folded in substantially closing the corresponding one of said top and bottom of said sleeve except for a uniformly wide gap formed between said edge of said first-in end flaps and the corresponding inner walls;

e) said gaps each extending along the top edge of the corresponding first-in end flap;

f) said second-in end flaps when folded in each overlying and in contact with a substantial portion of the corresponding first-in end flap and overlying said gap; and g) said blank having top and bottom boss means which when said blank is folded into said sleeve are adjacent the corresponding gap for cooperating with an additional carton element for preventing leakage through said gap.

35. A leak preventing carton blank as in claim 34 and wherein:

a) each of said boss means is an emboss.

36. A leak preventing carton for ice cream and the like comprising:

a) a rectangular sleeve of uniform thickness having top and bottom and inner walls forming a chamber for receiving ice cream;

b) said bottom and top each having inwardly folded first-in and second-in end flaps;

c) each of said end flaps having first, second and top edges;

d) at least one of said first-in end flaps substantially closing the corresponding one of said top and bottom of said sleeve except for a gap formed between said top edge of said at least one of said first-in end flaps and the corresponding inner wall;

e) said gap extending the length of the top edge of the corresponding first-in end flap;

f) said gap having first and second portions;

g) at least one of said second-in end flaps including a lip extending into said gap and filling substantially only said first portion; and h) said sleeve having a boss adjacent said second gap portion for preventing leakage through said second gap portion.

37. A leak preventing carton for ice cream and the like as in claim 36 and wherein:

a) said bottom and top each have a third-in end flap, and said boss is disposed on said third-in end flap.

38. A leak preventing carton blank for ice cream and the like comprising:

a) a plurality of panels for forming a sleeve of uniform thickness having a top and bottom and inner walls for forming a chamber for receiving ice cream when the carton blank is erected;

b) said bottom and top each having inwardly foldable first-in and second-in end flaps;

c) each of said end flaps having first, second and top side edges;

d) at least one of said first-in end flaps when folded in substantially closing the corresponding one of said top and bottom of said sleeve except for a gap formed between said top edge of said at least one of said first-in end flaps and the corresponding inner wall;

e) said gap extending the length of the top edge of the corresponding first-in end flap;

f) said gap having first and second portions;

g) at least one of said second-in end flaps including an infolded lip extending into said gap and filling substantially only said first portion; and h) said blank having a boss disposed at the corresponding one of said top and bottom such that when erected said boss is positioned directly adjacent said second portion of said gap for preventing leakage therethrough.

39. A leak preventing carton blank as in claim 38 and wherein:

a) said bottom and top each having a third-in end flap, and said boss is disposed on said third-in end flap.

* * * * *

UNITED STATES PATENT AND TRADEMARK OFFICE

CERTIFICATE OF CORRECTION

PATENT NO. : 5,160,082

DATED : November 3, 1992

INVENTOR(S) : Robert J. McCormick, James C. Zimmerman, B. Edward Shlesinger, Jr.

It is certified that error appears in the above-identified patent and that said Letters Patent is hereby corrected as shown below:

In the Abstract, line 2, delete "and" and insert therefor --end--.

Column 2, line 61, delete "flat" and insert therefor --flap--.

Column 6, line 47, delete "ad" and insert therefor --and--.

Column 7, line 47, delete "atop" and insert therefor --top--.

Signed and Sealed this

Seventh Day of December, 1993

*Attest:*

*Attesting Officer*

Bruce Lehman

BRUCE LEHMAN

*Commissioner of Patents and Trademarks*